United States Patent [19]

Moore et al.

[11] 4,068,668

[45] Jan. 17, 1978

[54] EAR LOBE PIERCING DEVICE

[75] Inventors: Larry D. Moore, Attleboro, Mass.; Isaiah W. Johnson, Greensboro; Charley L. Thompson, Jr., McLeansville, both of N.C.

[73] Assignee: Concept Marketing, Inc., Attleboro, Mass.

[21] Appl. No.: 611,449

[22] Filed: Sept. 8, 1975

[51] Int. Cl.[2] ..... A61B 17/00; F41B 7/00; F41C 19/00

[52] U.S. Cl. ..... 128/330; 124/27; 124/37

[58] Field of Search ..... 124/27, 28, 31, 40; 128/330

[56] References Cited

U.S. PATENT DOCUMENTS

| | | | |
|---|---|---|---|
| 2,043,677 | 6/1936 | Salomon | 124/27 UX |
| 3,941,134 | 3/1976 | McDonald | 128/330 |
| 3,943,935 | 3/1976 | Cameron | 128/330 |

*Primary Examiner*—Channing L. Pace
*Attorney, Agent, or Firm*—Salter & Michaelson

[57] ABSTRACT

An ear lobe piercing device for piercing an ear lobe with a stud, said device having means for holding an ear lobe to numb same prior to insertion of a stud into the lobe, said device further having a plunger for holding the stud, a trigger for both actuating said means for holding the ear lobe and cocking said plunger and trigger means operable by an index finger for releasing the plunger after said plunger has been cocked.

11 Claims, 6 Drawing Figures

EAR LOBE PIERCING DEVICE

BACKGROUND AND SUMMARY OF THE DISCLOSURE

This invention relates to a device for piercing an ear lobe and inserting an object therethrough for the purpose of creating an earring-receiving canal.

For many years women have worn or desired to wear earrings that could only be worn on ear lobes that had been pierced.

Over the years various surgical techniques have been used for piercing ear lobes. In addition, various ear piercing device, such as shown in U.S. Pat. Nos. 2,798,491 and 3,187,751, have been developed for piercing ear lobes by the insertion of a stud into the ear lobe.

While such device of the prior art were useful, they lacked certain features provided by the instant invention to facilitate insertion of a stud in simple or less painful manner.

For example, the device as shown in U.S. Pat. No. 2,798,491 does not provide for rapid insertion of the stud into the ear lobe or the rapid release therof from the ear lobe after insertion therein.

U.S. Pat. No. 3,187,751, on the other hand, is not self-cocking, that is, the plunger carrying the stud must be cocked by hand prior to closing the handle to clasp the ear lobe between the jaws thereof. In addition, if the plunger is cocked after the jaws are closed upon the ear lobe, the ear lobe is liable to be pulled. In addition, the device as shown in U.S. Pat. No. 3,187,751 uses a thumb-operated plunger release, and this is difficult to maneuver.

In view of the foregoing, this invention has as its primary object the provision of an ear lobe piercing device which overcomes the above-mentioned disadvantages and difficulties of the prior art.

In particular, this invention provides as one feature thereof a mechanism which serves two purposes: one, the clamping and numbing of the ear lobe and, two, the pre-loading or cocking of the plunger carrying stud prior to insertion of the stud into the ear lobe.

This invention also provides a new and improved plunger construction which facilitates the release of the stud therefrom after the stud is inserted into the ear lobe. As a further feature of this invention, there is provided an actuating or trigger mechanism operable by the index finger in much the same manner as a conventional trigger of a gun so that the position of the machine can easily be maneuvered to locate the stud with respect to the ear lobe.

Other objects, features and advantages of this invention will become apparent as the description thereof proceeds when considered in connection with the accompanying drawings.

DESCRIPTION OF THE DRAWINGS

In the drawings which illustrate the preferred embodiment presently contemplated for carrying out the present invention.

BRIEF DESCRIPTION OF THE DISLOSURE

Figure 1:
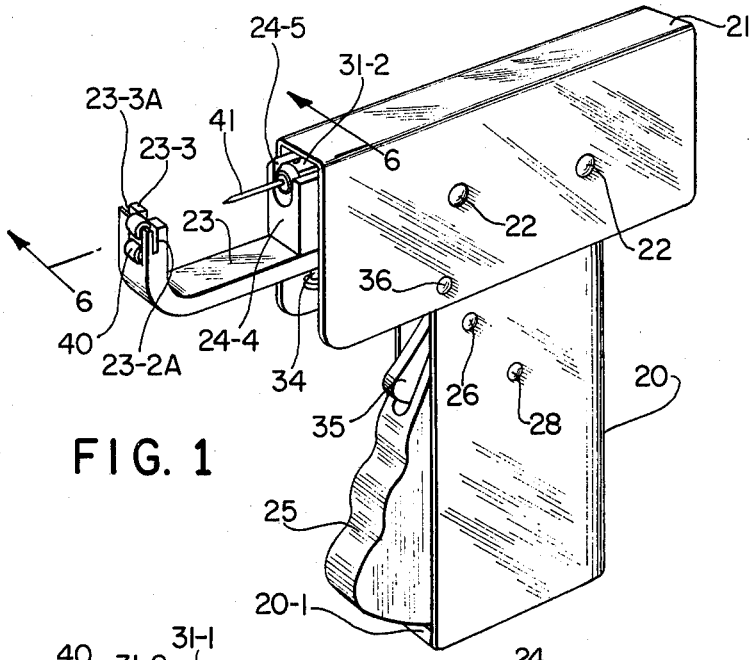
FIG. 1 is a perspective view of the ear lobe piercing device of this invention.
Figure 2:
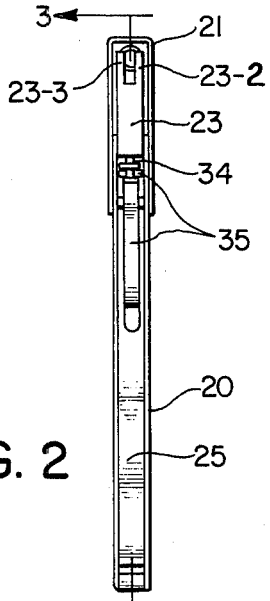
FIG. 2 is a front elevational view thereof.

This invention provides an ear lobe piercing device for inserting a portion of a stud into an ear lobe. The device includes means which in one squeezing motion of a user's hand causes both the ear lobe to be grasped and held for insertion of the stud and a plunger driving mechanism, e.g., a spring, to be readied or pre-loading to drive a plunger for carrying the stud, and which in a second squeezing motion of a finger of the same hand of the user permits the release of the plunger carrying that stud, thereby permitting said plunger driver mechanism to move said plunger towards the ear lobe in order to insert a portion of the stud through the ear lobe.

DETAILED DESCRIPTION OF THE DISCLOSURE

Referring to the drawings, there is shown a hollow handle 20 which has coupled thereto a cover 21. The cover 21 is coupled to the handle 20 by rivets 22 having flattened heads. At 23 there is provided an anchor holder which is fixed to the handle 20 and cover 21 by the aforementioned rivets 22.

At 24 there is provided a slide block positioned on a slide plane of the anchor holder. The slide block 24 is moved forward by pre-load activator or cocking trigger 25 mounted for pivotal motion to the handle 20 by a flat head rivet 26.

Figure 4:
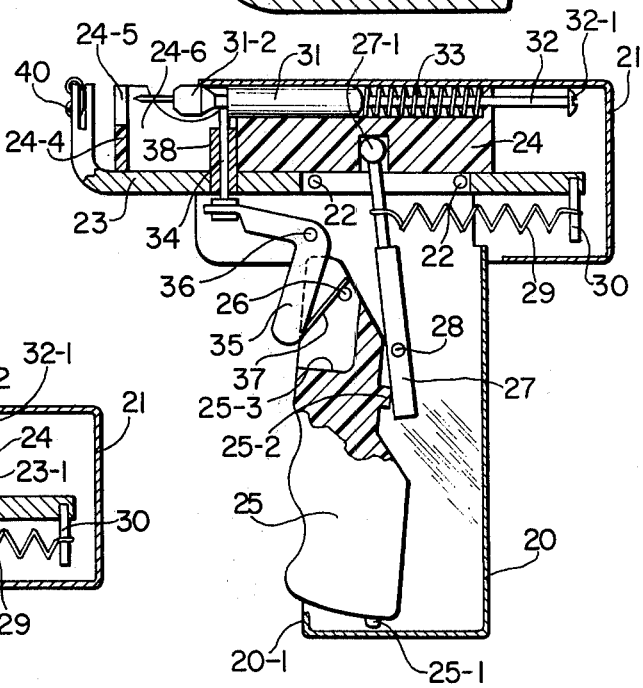
FIG. 4 is a view similar to FIG. 3 showing the plunger spring in a compressed state prior to release of the plunger.

A trigger projection is shown at 25-1 which engages handle stop 20-1 to limit trigger motion. A pivot arm 27 is coupled by rivet 28 to handle 20 and is rotated counterclockwise as seen in FIG. 4 by trigger projection 25-2.

Figure 3:
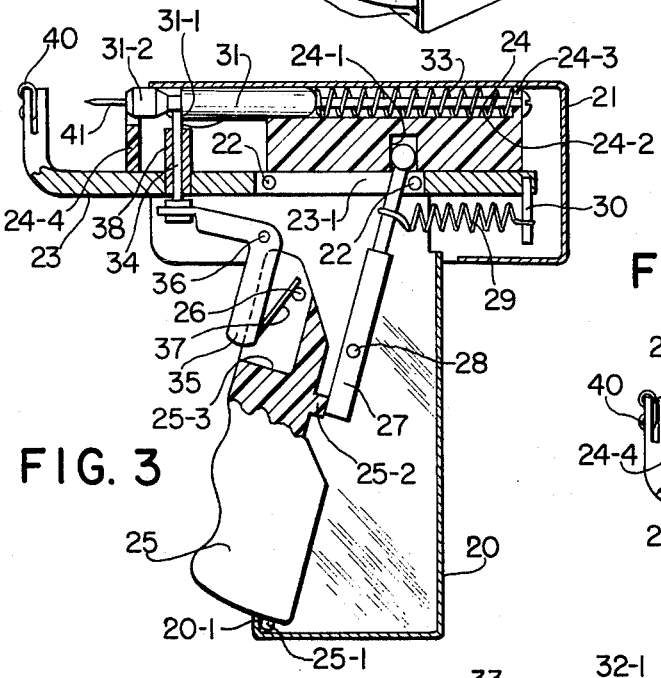
FIG. 3 is a partial sectional view taken on line 3—3 of FIG. 2.

The pivot arm 27 extends through a slot 23-1 provided in anchor holder 23 and includes a head 27-1 which is positioned in slide block 24-1. Thus counterclockwise rotation of trigger 25 and arm 27 will cause the block 24 to move to the left as seen in FIG. 4. Return of the block to the position see in FIG. 3 is provided by tension spring 29 coupled between pivot arm 27 and a member 30 connected to anchor holder 23.

At 31 there is shown a plunger supported in a partially open slot 24-2 in the block 24 for slidable motion. The plunger 31 is connected to a plunger pin 32 which is positioned in a bore 24-3 at the rear of the block 24.

The pin has a head 32-1 at one side of the bore 24-3, and the rear surface of block 24 acts as a stop therefor. A rubber washer (not shown) may be placed between the head and the bore 24-3 opening if desired as a shock absorber.

Figure 5:
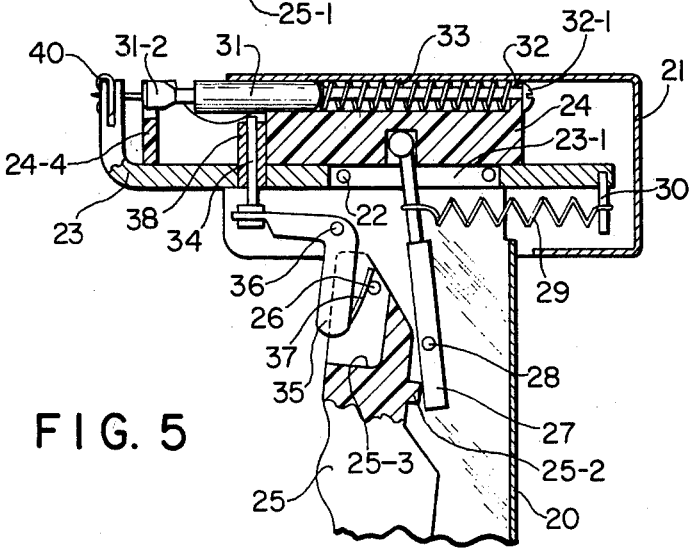
FIG. 5 is a view similar to FIG. 3 showing the release of the plunger.

A compression spring is shown at 33 for driving the plunger 31 to the left as shown in FIG. 5 after it is compressed by the motion of the block as shown in FIG. 4. The plunger extends through a slot 24-5 in the front or pressure plate 24-4 of the block 24, which pressure plate is spaced forwardly of block 24 and is connected thereto by side walls 24-6.

The spring 33 and the plunger 31 are retained in the slot 24-2 by the top of the cover 21 as shown in FIGS. 3-5. In order to effect compression of the spring 33, a plunger stop pin 34 is supported by a pivotally mounted plunger pin release trigger 35. The trigger is pivotally supported by rivet 36.

The pin 34 slides in the bore of a slide block stop member 38 mounted in a bore formed in member 23. The pin 34 is normally urged against plunger wall or shoulder 31-1 by release trigger compression spring 37 positioned in a hollow portion 25-3 of the trigger 25.

Upon rotation of the trigger 35 to the position shown in FIG. 5, pin 34 is retracted, and the plunger is released for forward motion (to the left, as shown in FIG. 5) pursuant to the action of spring 33. The member 38 acts as a forward stop for the block 24 as shown in FIGS. 4 and 5.

The anchor holder is provided with spaced-apart fingers or jaw segments 23-2 and 23-3 having slots 23-2A and 23-3A (see FIG. 1) for supporting a stud anchor 40 having a hole 40-1 (see FIG. 6) into which a stud 41 forming the hole in the ear lobe may be driven.

Figure 6:
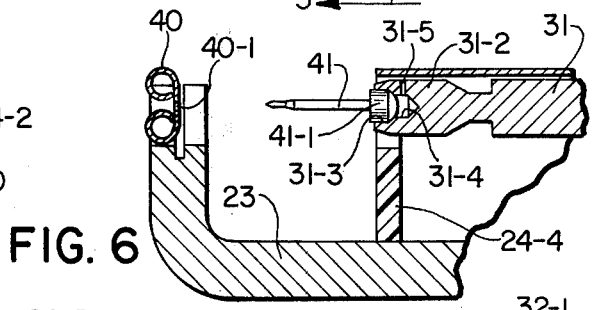
FIG. 6 is an enlarged sectional view taken on line 6—6 in FIG. 1 to illustrate the stud held by the plunger.

The stud 41 is retained in plunger head 31-2 in a bore 31-3 thereof (see FIG. 6). As a preferred feature of this invention, an air passage bore 31-4 is provided to the rear of the bore 31-3 which is coupled to another air passage bore 31-5 (see FIG. 6) to permit the stud to be easily released from the plunger bore 31-3 after insertion into the ear lobe. More specifically, bores 31-4 and 31-5 act as air vents to bore 31-3 to prevent a vacuum from forming in the latter, such as might cause undesirable sticking of the stud head 41-1 therein.

In operation, the anchor 40 is placed in the anchor holder 23 as shown in FIG. 3, and then the ear lobe is placed between the anchor and the stud 41 positioned in bore 31-3. At this time the actuator or trigger 25 is depressed as shown in FIG. 4 to compress spring 33 and to cause the ear lobe to be grasped between jaw segments 23-2 and 23-3 and the front 24-4 of the slide block which acts as a pressure plate. The grasping of the ear lobe tends to cause a temporary numbing of the lobe.

Thereafter, the trigger 35 is depressed as shown in FIG. 5 to retract pin 34 to permit the plunger 31 to be driven to the left by spring 33, as shown in FIG. 5. This causes the stud 41 to swiftly penetrate the ear lobe, after which the free forward end of the stud passes through aligned opening 40-1 of the anchor 40 for frictional retention thereby. The trigger 25 is then released, whereupon block 24 returns to its original position of FIG. 3 by means of spring 30, and the pierced lobe is released so that the machine may be removed therefrom. As plunger 31 retracts, pin 34 automatically positions itself in locking position against shoulder 31-1 whereby the device is ready for another operation.

While there is shown and described herein certain specific structure embodying the invention, it will be apparent to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An ear lobe piercing device comprising support means, clamping means supported by said support means adapted to clamp an ear lobe, plunger means supported by said support means for supporting a stud so that a portion thereof is adapted to be inserted into an ear lobe when held by said clamping means, means for releasably holding said plunger means in a non-operative position, actuating means operable to simultaneously close said clamping means and pre-load said plunger means, and trigger means for actuating said holding means to release said pre-loaded plunger for movement of said stud toward said clamping means, said trigger means being located closely adjacent said actuating means whereby said device and said actuating and trigger means may be easily and conveniently held and operated by a single hand.

2. The device of claim 1 wherein said device comprises a gun-like configuration, said support means comprising a handle which supports for pivotal motion said actuating means and said trigger means.

3. The device of claim 2 in which said clamping means includes a slide block upon which there is positioned said plunger means, said slide block coupled to said actuating means for straight-line motion towards said clamping means.

4. The device of claim 3 in which said plunger means comprises a plunger having a bore for holding a portion of the stud, and a spring located against said plunger and confined at the rear by said slide block, said spring being compressed upon operation of said actuating means.

5. The device of claim 1 in which said plunger means includes a bore for snugly and frictionally holding the head of said stud and in which an air passage is provided from the bore to the outside atmosphere.

6. The machine of claim 1 in which said actuating means and said trigger means are pulled in the same direction to operate same and in which resilient biasing means engaging said actuating means is positioned to bias said trigger means in a direction opposite to the direction of rotation of said actuating means when the latter is being rotated to close said clamping means and pre-load said plunger means.

7. An ear lobe piercing device comprising a handle having support means connected thereto, an anchor holder portion on said support means for holding an anchor, a slide block carried by said support means for linear motion towards and away from said anchor holder portion, an actuator pivotally coupled to said handle for linearly driving said block towards said anchor holder portion, a plunger and compression spring positioned on said slide block for independent linear motion relative thereto, a release pin for selectively restraining the motion of said plunger during motion of said slide block towards said anchor holder portion to cause said compression spring to be compressed during motion of said slide block towards said anchor holder portion to pre-load said plunger, and a trigger pivotally coupled to said handle for withdrawing said release pin whereby said plunger is released for rapid spring-driven movement toward said anchor holder portion, said plunger having means for supporting a stud for insertion into an anchor held by said holder portion.

8. The device of claim 7 in which said means for supporting a stud comprises a bore which snugly and frictionally receives said stud, said bore having an air passage coupled thereto which opens into the atmosphere.

9. The device of claim 7 in which said slide block includes a pressure plate and in which said pressure plate and said anchor holder portion act together to clamp an ear lobe therebetween.

10. The device of claim 9 in which said trigger is positioned closely adjacent said actuator whereby said device and said actuator and trigger may be easily and conveniently held and operated by a single hand.

11. An ear lobe piercing device comprising a handle portion having depressible actuator means, support means mounted on one end of said handle comprising a housing having an open end, said support means further having an upstanding portion in spaced relation to the open end of said housing, a slide block normally positioned within said housing, link means interconnecting said depressible actuator and said slide block whereby actuation of the former causes the latter to slidably move toward said upstanding portion to clamp an ear lobe positioned therebetween, a plunger slidably mounted in said housing for movement toward said upstanding portion, a release pin normally restraining said plunger from said movement, a spring between said slide block and said plunger whereby movement of the slide block toward said upstanding portion compresses said spring to pre-load said plunger, and trigger means on said handle operable to withdraw said release pin from its restraining position, thereby causing said compressed spring to swiftly move said plunger toward said upstanding portion.

* * * * *